United States Patent [19]

Kanno

[11] Patent Number: 4,460,282

[45] Date of Patent: Jul. 17, 1984

[54] TIMEPIECE STEPPING MOTOR DRIVE CIRCUIT WITH STEPPING FAILURE COMPENSATION

[75] Inventor: Fumio Kanno, Sayama, Japan

[73] Assignee: Citizen Watch Co., Tokyo, Japan

[21] Appl. No.: 259,156

[22] Filed: Apr. 30, 1981

[30] Foreign Application Priority Data

May 13, 1980 [JP] Japan ..... 55/63100

[51] Int. Cl.[3] ..... G04F 5/00

[52] U.S. Cl. ..... 368/157; 368/160; 318/696

[58] Field of Search ..... 368/160, 76, 159, 202, 368/157, 203, 204, 155, 156, 158, 217–219, 85–87; 318/696

[56] References Cited

U.S. PATENT DOCUMENTS 4,321,520 3/1982 Ueda et al. ..... 318/696
4,326,278 4/1982 Shida et al. ..... 318/696
4,340,946 7/1982 Kanno et al. ..... 368/76

FOREIGN PATENT DOCUMENTS 2030734 6/1979 United Kingdom .
2009464 4/1980 United Kingdom .

*Primary Examiner*—Bernard Roskoski
*Attorney, Agent, or Firm*—Birch, Stewart, Kolasch & Birch

[57] ABSTRACT

In an electronic timepiece utilizing a stepping motor, voltage induced in the electromagnetic coil of the motor due to free oscillation of a rotor thereof is detected in a plurality of successive detection periods after application of a driving force to the motor is completed, and it is determined on the basis of such induced voltage for the respective detection periods whether the rotor failed to step or not. If the stepping failure is determined in at least one detection period, a compensation pulse is fed to the stepping motor to compensate for the stepping failure of the rotor and thereafter driving energy supplied to the electromagnetic coil of the motor is increased.

7 Claims, 24 Drawing Figures

TIMEPIECE STEPPING MOTOR DRIVE CIRCUIT WITH STEPPING FAILURE COMPENSATION

BACKGROUND OF THE INVENTION

Field of the Ivention

This invention relates to an electronic timepiece, and more particularly to an electronic timepiece of the kind in which a stepping motor is driven by a varying driving force dependent upon the load of the timepiece.

There have been proposed various attempts to drive a stepping motor of an electronic timepiece by different driving force or different driving energy dependent upon the load of the timepiece, in order to minimize electric power consumed in the stepping motor (U.S. Pat. No. 4,158,287, U.K. patent application Nos. GB 2 009 464 A and GB 2 030 634 A). In these attempts, it is known to utilize a voltage induced in the rotor of the stepping motor due to its free oscillation after application of driving force to the stepping motor, in order to detect a high load being applied to the motor.

According to a conventional detection method utilizing such induced voltage, a detection period of a predetermined length of time is established within which the induced voltage is detected and it is determined that the rotor of the stepping motor failed to step only if all the induced voltages detected in the detection period remain below a predetermined level. Such a detection method is known as a unidirectional detection and has a drawback in that the timepiece operates improperly and will lose time as described in the following.

FIG. 1 of the accompanying drawings shows a conventional driving circuit of an electronic timepiece. The driving circuit consists of two P-MOS transistors 1 and 2 whose source terminals are connected to the positive terminal VDD of a voltage supply source and two N-MOS transistors 3 and 4 whose source terminals are connected to the negative terminal VSS of the voltage supply source. The drain terminals of the P-MOS transistor 1 and the N-MOS transistor 3 are connected to each other and the drain terminals of the P-MOS transistor 2 and the N-MOS transistor 4 are connected to each other. An electromagnetic coil 5 is connected between the drain terminals of transistors 1, 3 and transistors 2, 4 at the ends a and b of the coil 5. Inverters 6 and 7 are connected to the ends a and b of the electromagnetic coil 5, respectively. Both ends of the electromagnetic coil 5 may be grounded through a gate and a resistor of high resistance value (on the order of 100 KΩ) as shown by a dotted line in FIG. 1. The electromagnetic coil 5 constitutes a stepping motor in combination with a rotor 8 and a stator 9 as shown in FIG. 2. When driving signals are applied to the gate terminals of MOS transistors 1, 2, 3 and 4, a current will flow in the direction shown by the solid arrow in the event that P-MOS transistor 1 and N-MOS transistor 4 are only conductive while a current will flow in the direction shown by the broken arrow in the event that P-MOS transistor 2 and N-MOS transistor 3 are only conductive, so that the stepping motor or the rotor thereof will move angularly or stepwise. After completion of application of driving signals, two P-MOS transistors 1 and 2 will become non-conductive and two N-MOS transistors 3 and 4 will become conductive, and the electromagnetic coil 5 will be close-circuited through the ON resistance of the transistors 3 and 4. A short time after completion of application of the driving signals to the transistors 1, 2, 3 and 4, one of N-MOS the transistors 3 and 4 will become non-conductive and the electromagnetic coil 5 will be open-circuited. That is to say, only one of N-MOS transistors 3 and 4 among the four transistors 1, 2, 3 and 4 will become conductive and voltage will be induced at the end a or b of the electromagnetic coil 5 due to free oscillation of the rotor 8 of the stepping motor. Thereafter the electromagnetic coil 5 will be close-circuited and open-circuited alternatively. In the conventional method, it is determined that the rotor 8 of the stepping motor failed to step or angularly move by one step only when all the induced voltages detected in a predetermined detection period do not exceed a predetermined level.

FIG. 3 shows a waveform of a current which flows in the electromagnetic coil 5 when energized by a pulse train of a given mark-space ratio in a conventional manner. The waveform as shown obtained on the condition that the load on the stepping motor is relatively low and the rotor of the motor can step.

FIG. 4 shows voltage induced at the end a or b of the electromagnetic coil 5 in case of FIG. 3. In the detection period as marked c, the induced voltages exceed a predetermined reference level which may be a threshold level Vth of the inverters 6 or 7 shown in FIG. 1, so that it is determined that the rotor did not fail to step or the rotor could drive its load.

FIG. 5 shows a waveform of a current which flows in the electromagnetic coil 5 when energized in a conventional manner. The waveform as shown is obtained on the condition that the load on the stepping motor is high and the rotor of the motor fails to step.

FIG. 6 shows voltage induced at the end a or b of the electromagnetic coil 5 in case of FIG. 5. In the detection period c, the induced voltages do not exceed the predetermined reference level Vth, so that it is determined that the rotor failed to step or the rotor could not drive its load. Upon judgment of stepping failure of the rotor, a compensation pulse signal is fed to a driving circuit of the stepping motor so that the rotor is driven to step or to move by one step.

FIG. 7 shows a waveform of a current which flows in the electromagnetic coil 5 when energized in a conventional manner. The waveform as shown is obtained on the condition that a load to the stepping motor is relatively high and the rotor of the motor could step with difficulty.

FIG. 8 shows voltage induced at the end a or b of the electromagnetic coil 5 in case of FIG. 7. In the detection period c, the induced voltages do not exceed the predetermined reference level Vth, so that it is determined that the rotor failed to step, notwithstanding the fact that the rotor could step as above-mentioned. As a result, a compensation pulse signal is fed to the driving circuit of the stepping motor in the like manner as above-mentioned. In this particular case, however, the rotor 8 is somewhat rotated in a reverse direction and has no influence upon the stepping of the rotor. Therefore, no wrong operation will occur in the electronic timepiece.

FIG. 9 shows a waveform of a current which flows in the electromagnetic coil 5 when energized in a conventional manner. The waveform as shown is obtained on the condition that a load on the stepping motor is relatively high and the rotor of the motor could step with difficulty.

FIG. 10 shows voltage induced at the end a or b of the electromagnetic coil 5 in case of FIG. 9. In the detection period c, all the induced voltages exceed the predetermined level Vth, so that it is determined that the rotor did not fail to step.

In this case, however, determination of stepping failure is made while magnetic potential is being increased in the rotor 8, and therefore there is possibility for the rotor to return its precedent position due to change in load which may be caused by engagement of the gear train or the impact applied on the body of the timepiece from its outside, just after it has been judged in the detection period c that the rotor had not failed to step. In such a case, the rotor 8 is of opposite polarity to the current flowing in the electromagnetic coil 5 and the rotor 8 will not step, even if a compensation pulse signal is fed to the driving circuit of the stepping motor. As a result, the timepiece will lose two seconds. Such a problem will occur more frequently, if a driving current of the timepiece is made less from the standpoint of energy saving, and this problem is fatal to the conventional unidirectional detection method as above-mentioned.

SUMMARY OF THE INVENTION

It is therefore an object of the present invention to improve the above-mentioned drawback and to provide an electronic timepiece which consumes less electric power and does not operate improperly. According to the present invention, this object is attained by providing at least two detection periods in each of which the voltages induced in the rotor of the stepping motor are detected and by determining from such induced voltages whether the rotor has failed to step in each detection period, and by supplying a compensation signal to the stepping motor for compensation for the failure of stepping of the rotor only when the stepping failure is detected in at least one detection period. As a result, incorrect operation of the timepiece can be prevented under the condition of less driving energy.

Other and further objects of the invention will become obvious to those skilled in the art in the following description and the accompanying drawing in which:

DETAILED DESCRIPTION OF THE PREFERRED EMBODIMENTS

To begin with, explanation will be given to the way of detecting failure of stepping of a rotor.

Figure 11:
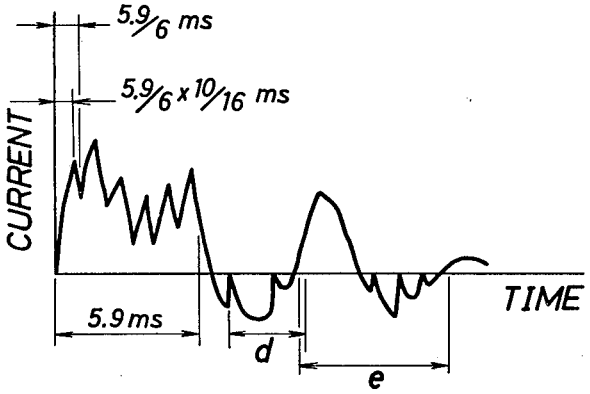
FIGS. 11, 13, 15 and 17 show waveforms of currents which flow in the electromagnetic coil of the stepping motor when energized according to the present invention.

FIG. 11 shows a waveform of a current which flows in the electromagnetic coil 5 according to the present invention. The current has a pulse waveform having pulse width of 5.9 msec and consisting of six pulses, and the mark to space ratio of the current is 10/16 to 6/16 (hereinafter referred to as "duty cycle 10/16" to "6/16"). The waveform shown in FIG. 11 is obtained on the condition that a load on the stepping motor is comparatively low and the rotor can step.

Figure 1:
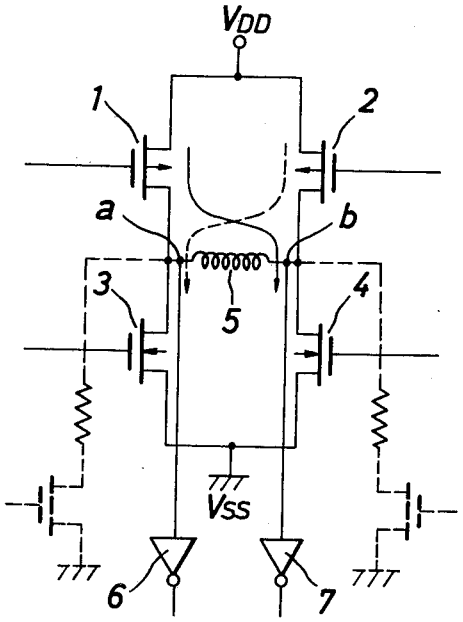
FIG. 1 is a driving circuit of an electronic timepiece.
Figure 2:
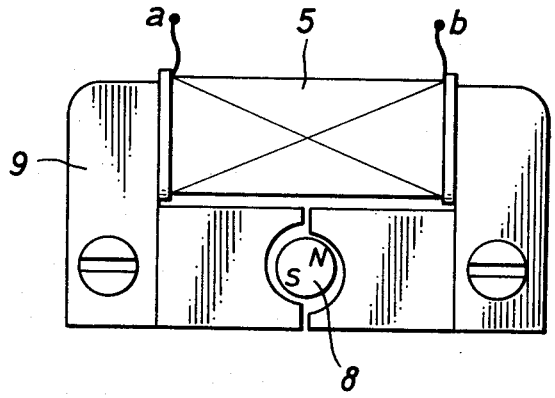
FIG. 2 is a plan view of a stepping motor.
Figure 3:
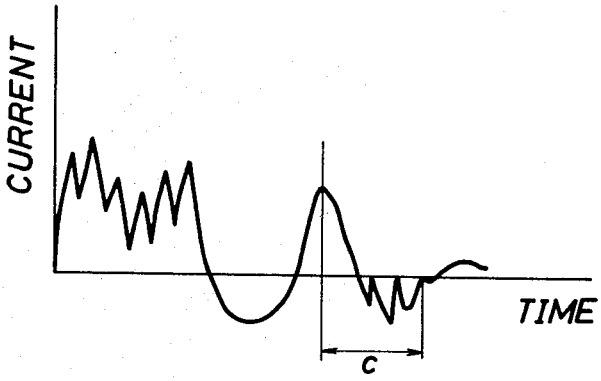
FIGS. 3, 5, 7 and 9 show waveforms of currents which flow in an electromagnetic coil of a stepping motor when energized in a conventional manner.
Figure 4:
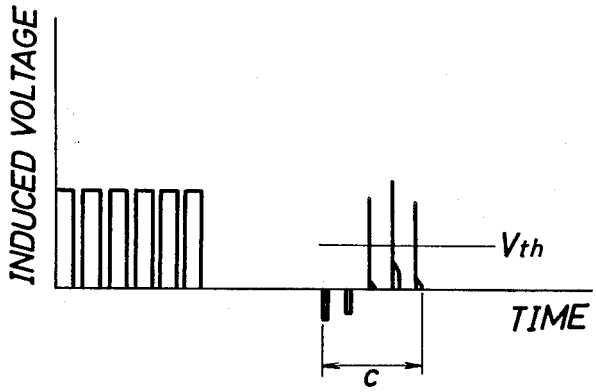
FIGS. 4, 6, 8 and 10 show waveforms of voltages induced at one end of the electromagnetic coil of the stepping motor in connection with FIGS. 3, 5, 7 and 9, respectively.
Figure 5:
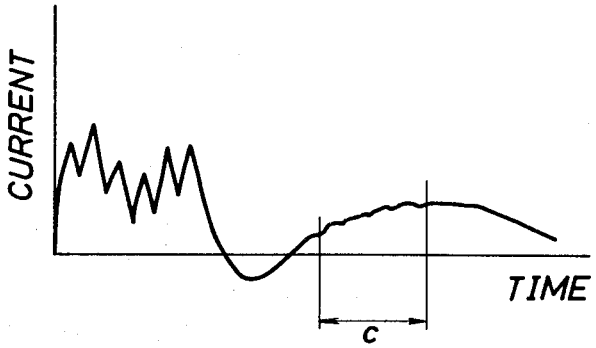
Figure 6:
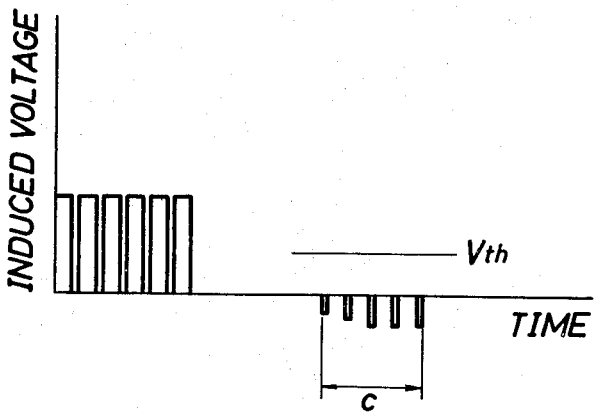
Figure 7:
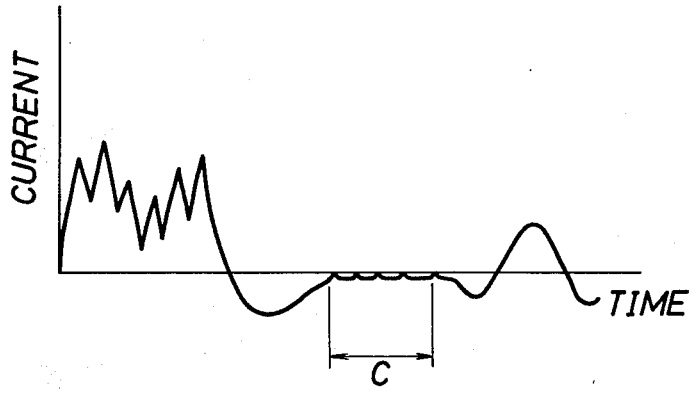
Figure 8:
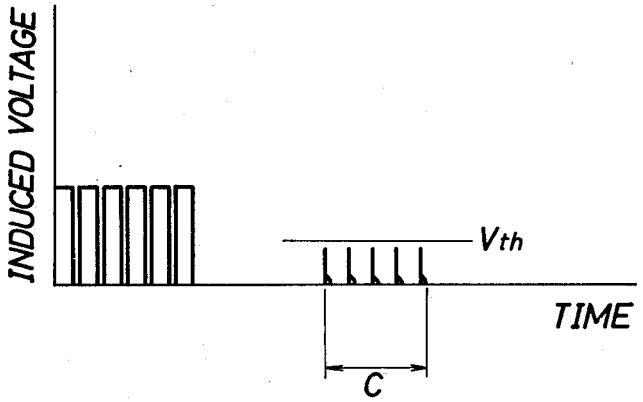
Figure 9:
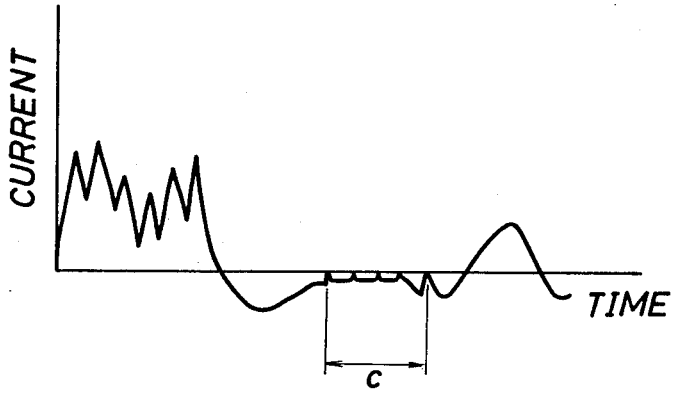
Figure 10:
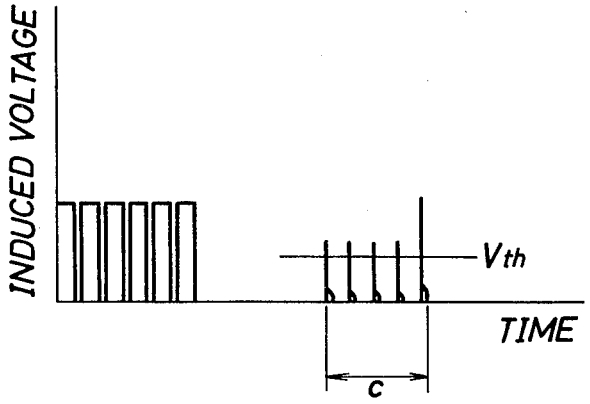
Figure 12:
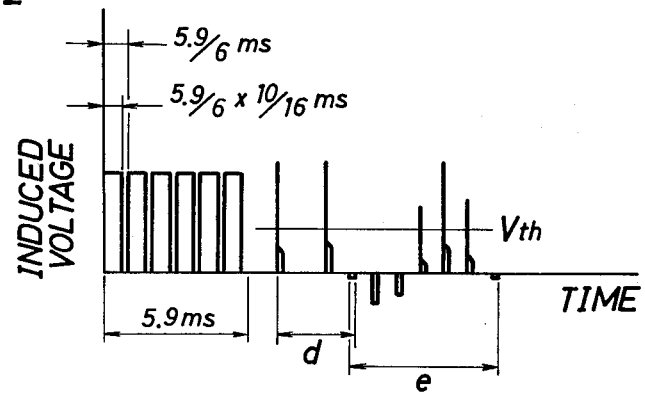
FIGS. 12, 14, 16 and 18 show waveforms of voltages induced at one end of the electromagnetic coil of the stepping motor in connection with FIGS. 11, 13, 15 and 17, respectively.

FIG. 12 shows voltages induced at the end a or b of the electromagnetic coil 5. A driving pulse signal is applied to the stepping motor during the period of the first 5.9 msec and the period of free oscillation of the rotor which follows application of the driving pulse signal to the motor is divided into two detection periods d and e as shown in FIG. 12 by way of example. In the first detection period d, failure of stepping of the rotor is detected at three positions that is at times of 7 msec, 9 msec and 10 msec after the time of application of the driving signal and it is determined that the rotor failed to step, if all the induced voltages detected at these three positions in the first detection period d exceed the level Vth of the inverters 6 and 7 shown in FIG. 1. As a matter of fact, however, all the induced voltages detected at the three positions in the first detection period d do not generally exceed the level Vth and it is therefore determined that the rotor did not fail to step. In the second detection period e, failure of stepping of the rotor is detected at seven positions that is at times of 10 msec, 11 msec, 12 msec, 13 msec, 14 msec, 15 msec and 16 msec after the time of application of the driving signal and it is determined that the rotor failed to step, if all the induced voltages detected at these seven positions in the second detection period e do not exceed the level Vth of the inverters 6 and 7. As a matter of fact, however, some of the induced voltages detected at the seven positions in the second detection period e generally exceed the level Vth and it is therefore determined that the rotor did not fail to step. In the present embodiment, the electromagnetic coil 5 is controlled to be open-circuited for about two milliseconds at times of 7 msec, 9 msec, 10 msec, 11 msec, 12 msec, 13 msec, 14 msec, 15 msec and 16 msec after the time of application of the driving signal. The first detection period d includes three positions at times of 7 msec, 9 msec and 10 msec after the time of application of the driving signal and the second detection period e includes seven positions between 10 msec and 16 msec after the time of application of the driving signal. The position at time of 10 msec is included both in the first detection period d and the second detection period e. It is of course possible to change the positions and the times of open-circuiting of the electromagnetic coil 5 and the time of maintaining the electromagnetic coil 5 in an open-circuited condition, if desired. It is also possible that the first detection period d and the second detection period e do not overlap each other.

Figure 13:
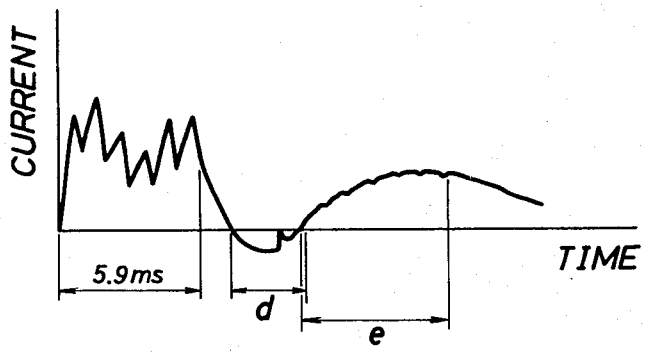

FIG. 13 shows a waveform of a current which flows in the electromagnetic coil 5 when energized by a driving pulse of duty 10/16 according to the present invention. The waveform as shown is obtained on the condition that a load on the stepping motor is so high that the rotor fails to step.

Figure 14:
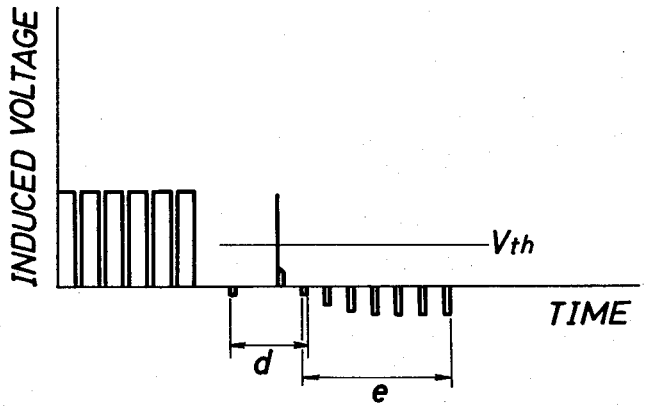

FIG. 14 shows voltages induced at the end a or b of the electromagnetic coil 5 in case of FIG. 13. In the first detection period d, the induced voltages do not exceed the level Vth of the inverters 6 or 7 at two positions and therefore it is determined that the rotor did not fail to step. On the contrary, in the second detection period e, the induced voltages do not exceed the level Vth at all of the seven positions and it is determined that the rotor failed to step. As a result, a compensation pulse signal is fed to the stepping motor so as to step the rotor.

Figure 15:
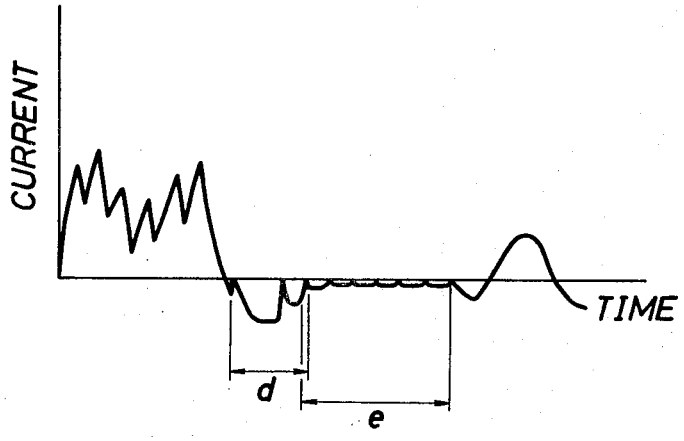

FIG. 15 shows a waveform of a current which flows in the electromagnetic coil 5 when energized by a driving pulse of duty 10/16 according to the present invention. The waveform as shown is obtained on the condition that the load on the stepping motor is relatively high and the rotor could step only with difficulty.

Figure 16:
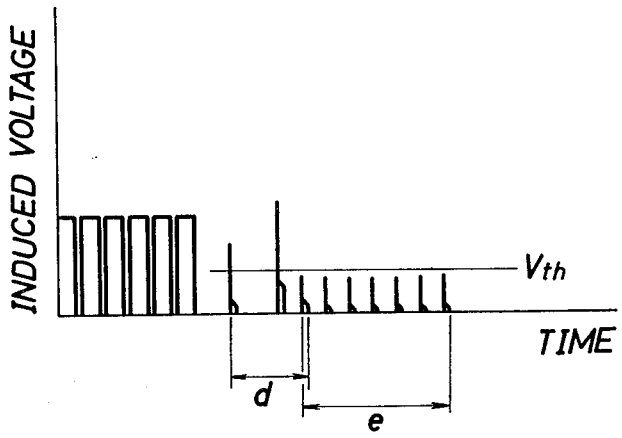

FIG. 16 shows voltages induced at the end a or b of the electromagnetic coil 5 in case of FIG. 15. In the first detection period d, the induced voltages do not exceed the level Vth of the inverters 6 or 7 at all the three positions and it is therefore determined that the rotor did not fail to step. On the contrary, in the second detection period e, the induced voltages do not exceed the level Vth at all the positions and it is therefore determined that the rotor failed to step. As a result, a compensation pulse signal is fed to stepping motor. However, as the rotor already stepped, the compensation pulse signal is of the same polarity as the rotor 8, so that the rotor 8 is not rotate forwardly, but somewhat vibrated.

Figure 17:
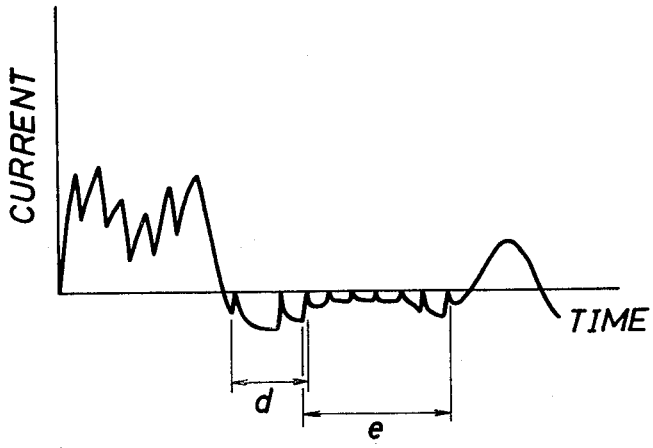

FIG. 17 shows a waveform of a current which flows in the electromagnetic coil 5 when energized by a driving pulse of duty 10/16 according to the present invention. The waveform as shown is obtained in such a condition that a load on the stepping motor is relatively high and the rotor could step with difficulty.

Figure 18:
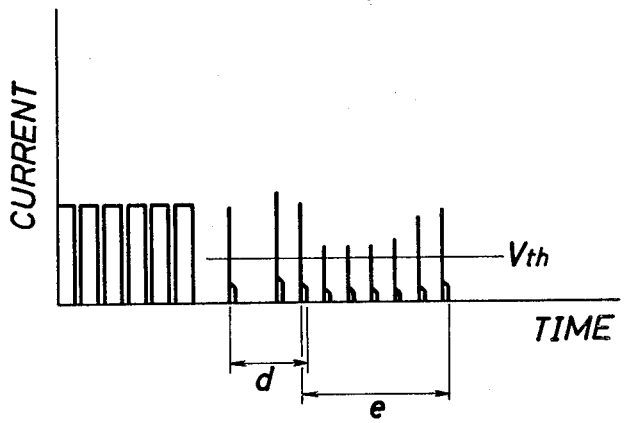

FIG. 18 shows voltages induced at the end a or b of the electromagnetic coil 5 in case of FIG. 17. In the second detection period e, the induced voltages exceed the level Vth of the inverters 6 or 7 at all the seven positions and it is determined that the rotor did not fail to step. On the contrary, in the first detection period d, the induced voltages exceed the level Vth at all the three positions and it is determined that the rotor failed to step. As a result, a compensation pulse signal is fed to the stepping motor. If there is no change in the load on the motor in the period after the second detection period e, the compensation pulse signal acts only to vibrate the rotor somewhat, but does not have any influence on the stepping of the rotor 8. However, if the load on the motor changes in the period following the second detection period e due to, for example, any impact on the body of the timepiece, so that the rotor 8 cannot step forwardly, but is returned to its precedent position, then the compensation pulse signal is effective to step the rotor 8 and thus compensates for failure of the stepping of the rotor 8.

In the present invention, a detection period d is provided between the time of completion of application of a driving pulse and the detection period e which has been employed in a conventional method, and detection of failure of stepping of a rotor is conducted in the detection period d in an opposite phase to the detection in the detection period e. In this way, failure of rotor stepping is twice detected to prevent erroneous operation of the timepiece due to change in the load on the motor which may be caused by impacts or the like applied to the body of the timepiece.

Figure 19:
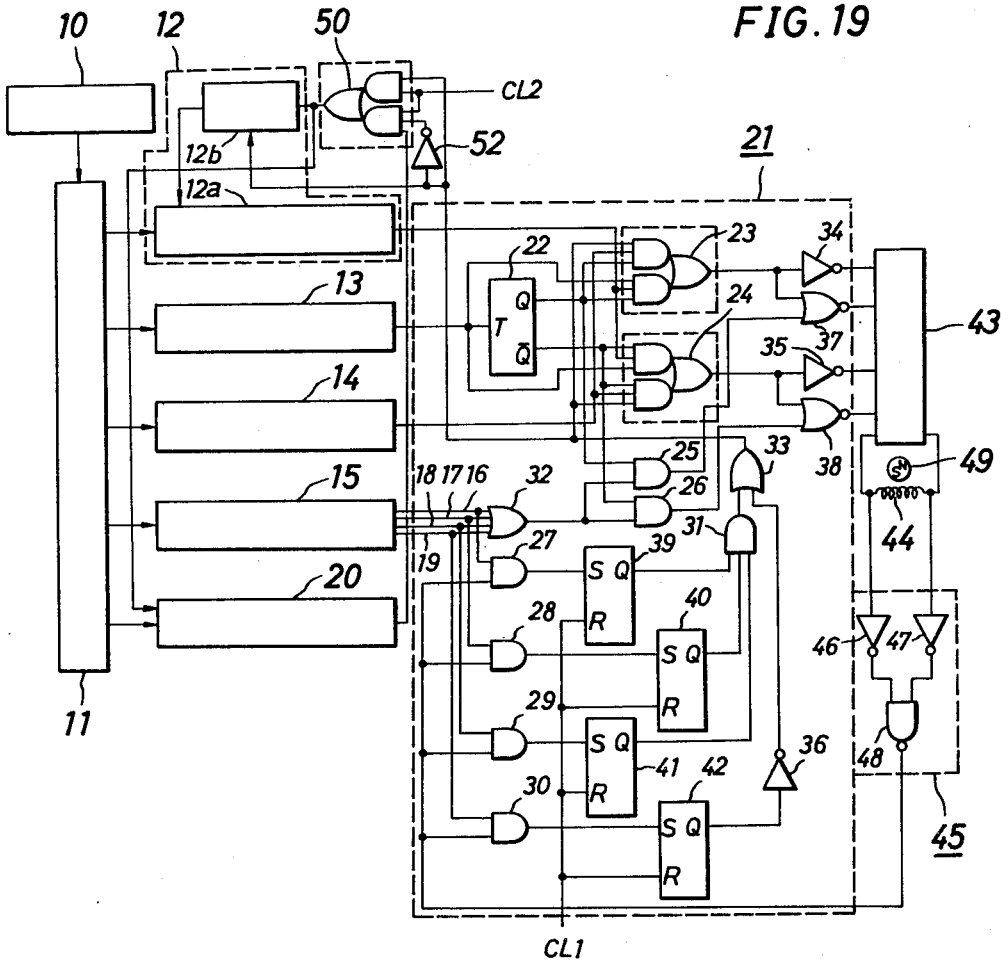
FIG. 19 is an embodiment of the driving circuit of an electronic timepiece according to the present invention.
Figure 20:
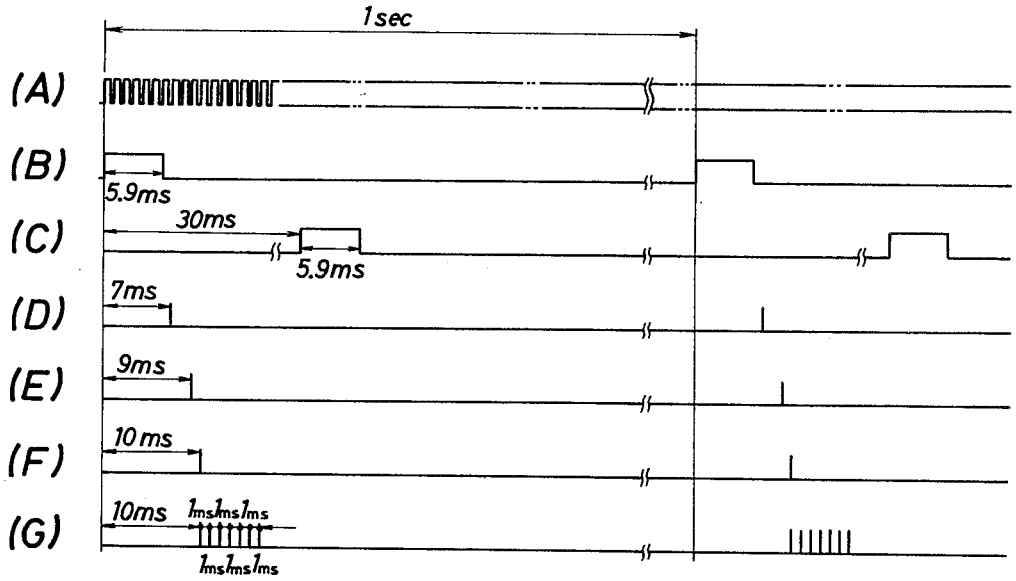
FIG. 20 shows waveforms of outputs at some points in the driving circuit shown in FIG. 19.
Figure 22:
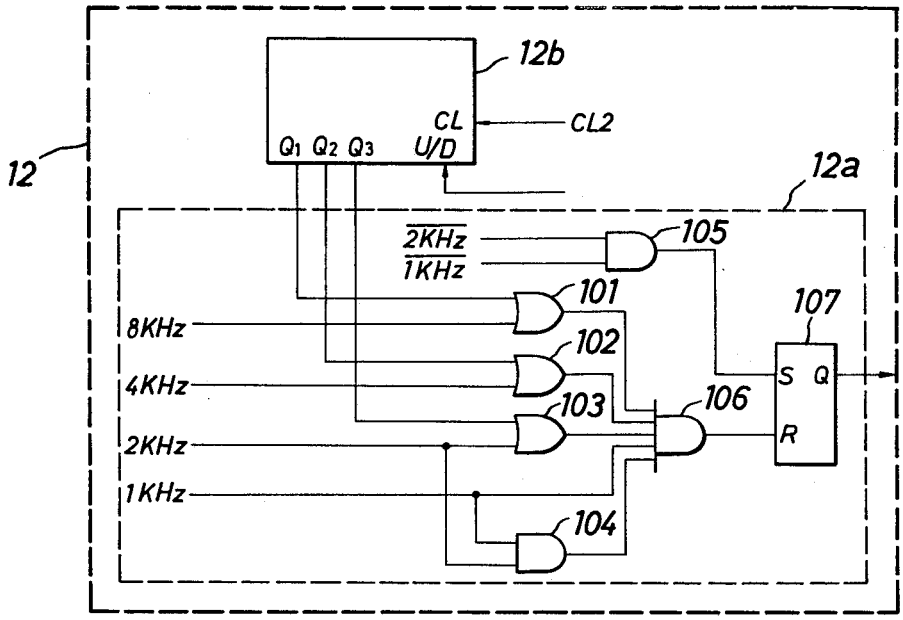
FIG. 22 is an embodiment of a driving energy control means employed in the driving circuit shown in FIG. 19.

Referring to FIG. 19 which shows a preferred embodiment of a circuit for driving an electronic timepiece according to the present invention, reference numeral 10 designates a time standard oscillator including a quartz oscillator and 11 designates a frequency divider. 12 denotes a driving energy control means for controlling driving energy of a signal (driving pulse) to be supplied to a stepping motor, which comprises a duty cycle determining circuit adapted to determine duty cycle or mark to space ratio of the driving pulse in this embodiment. The duty cycle determining circuit 12 consists of a duty cycle selecting circuit **12*a* for selecting a proper duty cycle within the range between 9/16 and 16/16, and up/down counter 12*b* for controlling the duty cycle selecting circuit 12*a* and generating a signal as shown in FIG. 20(A). A detailed example of the duty cycle determining circuit 12 is shown in FIG. 22 and will be described hereinafter. Element 13 is a driving pulse generating circuit which generates a pulse signal having pulse width of 5.9 msec as shown in FIG. 20(B) at every one second. Element 14 is a compensation pulse generating circuit which generates a pulse signal having a pulse width of 5.9 msec as shown in FIG. 20(C) at every one second. This pulse signal is delayed in phase by 30 msec from the pulse signal generated by the driving pulse generating circuit 13. Element 15 is a detection control means for controlling an induced voltage detecting means as hereinafter described, which comprises an electromagnetic coil switching pulse generating circuit for intermittently open-circuiting and close-circuiting the electromagnetic coil. The circuit 15 generates on a signal line 16 a signal as shown in FIG. 20(D), on a signal line 17 a signal as shown in FIG. 20(E), on a signal line 18 a signal as shown in FIG. 20(F) and on a signal line 19 a signal as shown in FIG. 20(G). 20 is a timer which generates an inverted pulse at every 60 seconds. The duty cycle determining circuit 12, the driving pulse generating circuit 13, the compensation pulse generating circuit 14, the electromagnetic coil switching pulse generating circuit 15 and the timer 20 are fed with outputs at appropriate output stages of the frequency divider 11**.

Figure 21:
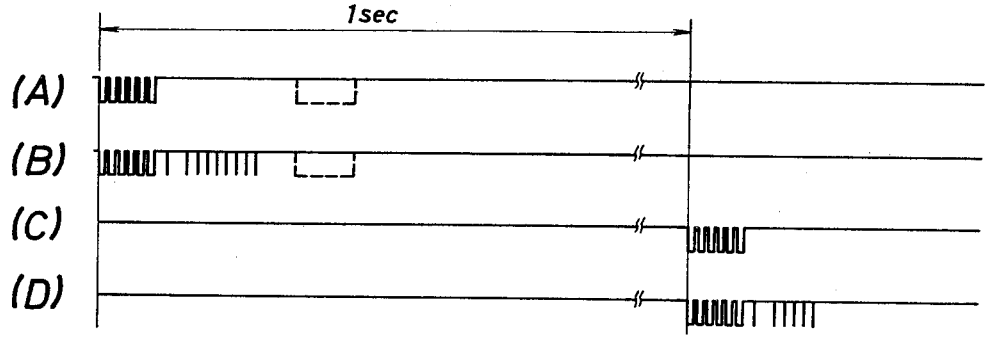
FIG. 21 shows waveforms of signals which are applied to the driving circuit shown in FIG. 19 according to the present invention.

Element 21 denotes a driving pulse control circuit which includes a flip-flop 22 of the toggle type (hereinafter referred to as "T-FF"), selecting gates 23 and 24, AND gates 25, 26, 27, 28, 29, 30 and 31, OR gates 32 and 33, inverters 34, 35 and 36, NOR gates 37 and 38 and flip-flops 39, 40, 41 and 42 of setreset type (hereinafter referred to as "S-R FF"). The output signal from the duty cycle determining circuit 12 is fed to the selecting gates 23 and 24, the output signal from the driving pulse generating circuit 13 is fed to T-FF 22 and the selecting gates 23 and 24, and the output of the compensation pulse generating circuit 14 is fed to the selecting gates 23 and 24. In the present embodiment, the compensation pulse generating circuit 14 and the selecting gates 23 and 24 constitutes a compensation pulse supplying means which compensates for failure of stepping of the rotor. The output of the electromagnetic coil switching pulse generating circuit 15 is fed to AND gates 27, 28, 29 and 30 through signal lines 16, 17, 18 and 19, respectively and to AND gates 25 and 26 through OR gate 32. The outputs of T-FF 22 and OR gate 33 are fed to the selecting gate 24 in addition to the above-mentioned signals. The output of the selecting gate 23 is fed to the inverter 34 and OR gate 37. The inversed output of T-FF 22 and the output of OR gate 33 are fed to the selecting gate 24 in addition to the above-mentioned signals. The output of the selecting gate 24 is fed to the inverter 35 and NOR gate 38. The output of T-FF 22 is applied to AND gate 25 in addition to the above-mentioned signal and the output of AND gate 25 is fed to NOR gate 37. The inversed output of T-FF 22 is applied to AND gate 26 in addition to the above-mentioned signal and the output of AND gate 26 is fed to NOR gate 38. The output of the induced voltage detection circuit 45 which will be described hereinafter is applied to AND gates 27, 28, 29 and 30, in addition to the above-mentioned signal. The outputs of AND gates 27, 28, 29 and 30 are fed to set terminals S of S-R FF 39, 40, 41 and 42, respectively. In the present embodiment, S-R FF 39, 40 and 41 and AND gates 27, 28 and 29 constitutes a first detection circuit for detecting failure of stepping of a rotor in the first detection period d. S-R FF 42 and AND gate 30 constitutes a second detection circuit for detecting failure of stepping of the rotor in the second detection period e. The output of the first detection circuit is fed to OR gate 33 through AND gate 31 and the output of the second detection circuit is fed to OR gate 33 through the inverter 36. AND gates 27, 28, 29 and 30 which constitute the first and the second detection circuits serve as selection gates for selecting a detection signal which is fed from the induced voltage detection circuit 45 in synchronization with the electromagnetic coil switching pulse. The output of OR gate 33 is fed to a selecting gate 50 and the up/down counter 12*b* of the duty determining circuit 12. The output of OR gate 33 is also fed to the selecting gate 50 through an inverter 52. Therefore, a driving circuit 43 is supplied with signal shown in FIG. 21(A) from the inverter 34, a signal shown in FIG. 21(B) from NOR gate 37, a signal shown in FIG. 21(C) from the inverter 35 and a signal shown in FIG. 21(D) from NOR gate 38. Element 44 is an electromagnetic coil which is one of the components of the stepping motor, and Element 45 is the induced voltage detection circuit as above-mentioned which includes the inverters 46, 47 and NAND gate 48. The circuit 45 detects the voltage induced in the electromagnetic coil 44 by vibration of the rotor 49 and generates an output signal depending upon the condition of the induced voltage. The rotor 49 is arranged to drive the hands of the timepiece through gear trains. The selecting gate 50 is controlled by the outputs of the timer 50, OR gate 33 and a clock signal CL and generates an output signal which is fed to the up/down counter 12*b* of the duty cycle determining circuit 12 as a clock signal and to the timer 20 as a reset signal.

Figure 23:
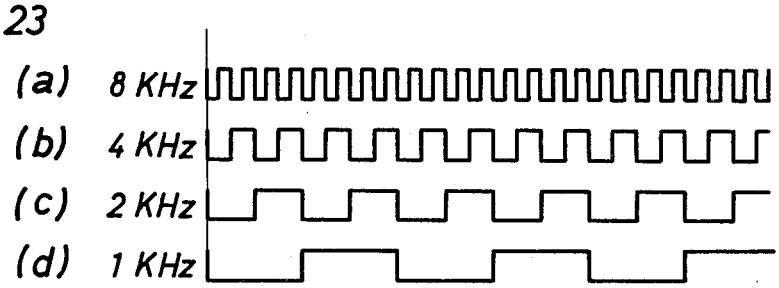
FIG. 23 shows waveforms of signals which are applied to the driving energy control means shown in FIG. 22.

The duty cycle determining circuit 12 will be described in detail with reference to FIGS. 22 to 24.

The duty cycle determining circuit 12 consists of the duty cycle selecting circuit 12*a* and the up/down counter 12*b* as above-mentioned. The up/down counter 12*b* has a clock input terminal CL, an up/down control terminal U/D and output terminals $Q_1$, $Q_2$, $Q_3$. In the case of where a "H" signal is applied to the U/D terminal, the up/down counter operates in an up counting mode while in the case where a "L" signal is applied to the U/D terminal, the counter 12*b* operates in a down counting mode. The counter 12*b* will have an output at the output terminals $Q_1$, $Q_2$ and $Q_3$ which increases or decreases according to the counting mode of the counter 12*b*. The duty cycle selecting circuit 12*a* includes OR gates 101, 102 and 103, AND gates 104, 105 and 106 and S-R flip-flop (hereinafter referred to as "S-R FF") 107. OR gate 101 is supplied with the output derived from the output terminal $Q_1$ of the counter 12*b* and a pulse signal of 8 KHz as shown in FIG. 23(*a*) from the frequency divider 11. OR gate 102 is supplied with the output from the output terminal $Q_2$ of the counter 12*b* and a pulse signal of 4 KHz as shown in FIG. 23(*b*) from the frequency divider 11. OR gate 103 is supplied with the output from the output terminal $Q_3$ of the counter 12*b* and a pulse signal of 2 KHz as shown in FIG. 23(*c*) from the frequency divider 11. AND gate 104 is supplied with pulse signals of 2 KHz and 1 KHz as shown in FIGS. 23(*c*) and 23(*d*) from the frequency divider 11. AND gate 105 is supplied with inversed pulse signals of 2 KHz and 1 KHz from the frequency divider 11. AND gate 106 is supplied with the outputs of OR gates 101, 102 and 103, the output of AND gate 104 and a pulse signal of 1 KHz as shown in FIG. 23(*d*) from the frequency divider 11. The output of AND gate 106 is fed to the reset terminal R of S-R FF 107 and the output of AND gate 105 is fed to the set terminal S of S-R FF 107.

Figure 24:
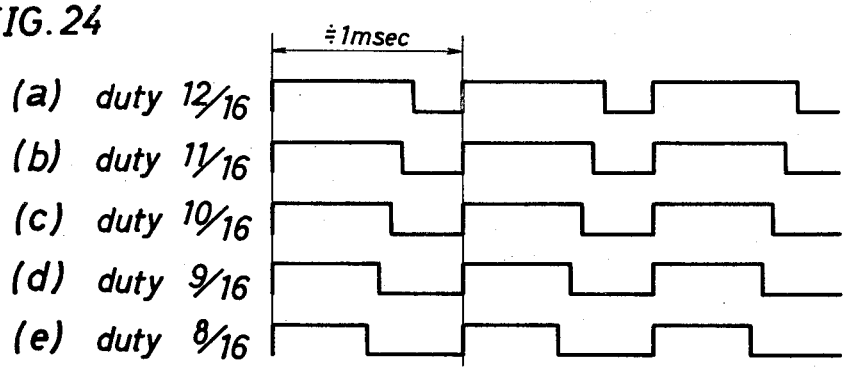
FIG. 24 shows waveforms of outputs derived from the driving energy control means shown in FIG. 22.

With the duty cycle determining circuit 12 thus arranged, if it is assumed that outputs "1", "1" and "0" are derived from the output terminals $Q_1$, $Q_2$ and $Q_3$, respectively of the up/down counter 12*b* in the initial condition, the output of S-R FF 107 will have duty cycle 12/16 as shown in FIG. 24(*a*). If the outputs at the output terminals $Q_1$, $Q_2$ and $Q_3$ have changed to "0", "0" and "1" as a result of increase in the count of the counter 12*b* by one, the output of S-R FF 107 will have duty 11/16 as shown in FIG. 24(*b*). As the count of the counter 12*b* increases one by one, the duty of the output of S-R FF 107 will be decreased as 10/16, 9/16, 8/16, ... as shown in FIG. 24(*c*), (*d*), (*e*), ... No outputs having duty 13/16 to 16/16 will appear from S-R FF 107, as the output of AND gate 104 is applied to AND gate 106.

Explanation will now be given to the operation of the electronic timepiece with the above-mentioned structure.

Assuming that the duty cycle determining circuit 12 selects the duty cycle 10/16 as an initial condition, the stepping motor is driven with a driving signal of duty cycle 10/16 by means of the time standard oscillator 10, the frequency divider 11, the driving pulse generating circuit 13, the driving pulse control circuit 21 and the driving circuit 43. If it is assumed that the load on the motor is low and the rotor 49 will step, such induced voltages as shown in FIG. 12 will be applied to the inverters 46 or 47. In this case, an "H" signal is applied to the set terminal S of S-R FF 39 and 40, so that S-R FF 39 and 40 whose output signals have been maintained at "L" level by means of a clock signal $CL_1$ will have outputs of "H" level and be maintained as they are. On the other hand, a "L" signal is applied to the set terminal S of S-R FF 41 and its output is maintained at "L" level, so that the output of AND gate 31 is maintained at "L" level. A "H" signal is applied to the set terminal S of S-R FF 42, so that S-R FF 42 whose output signal has been maintained at "L" level by means of a clock signal $CL_2$ will have an output of "H" level and be maintained as it is. As a result, OR gate 33 will have an output of "L" level and no compensation pulse signal as shown by a dotted line in FIGS. 21(A) and 21(B) will be applied to the driving circuit 43.

Next, it is assumed that the stepping motor is driven with a driving signal of the duty cycle 10/16 and the load on the motor is so high that the rotor 49 cannot step and such induced voltage as shown in FIG. 14 is applied to the inverters 46 or 47. In this case, the output of S-R FF 40 is of "H" level while the outputs of S-R FF 39 and 41 are of "L" level, so that the output of AND gate 31 will be of "L" level. However, as the output of S-R FF 42 is of "L" level, the output of OR gate 33 will be of "H" level. As a result, a compensation pulse signal as shown by a dotted line in FIGS. 21(A) and 21(B) will be applied to the driving circuit 43, so that the rotor 49 will be able to step. On the other hand, when the output of OR gate 33 is of "H" level, application of a clock signal $CL_2$ to the selecting gate 50 will cause the up/down counter 12*b* of the duty cycle determining circuit 12 to operate, so that the duty cycle determining circuit 12 will change its operating mode. As a result, a driving signal of the duty cycle 11/16 is derived from the circuit 12 from the following step and the timer 20 is reset and starts again. When 60 seconds which were set by the timer 20 have passed after the rotor 49 was driven with a driving signal of duty 11/16, a signal of "H" level is applied to the selecting gate 50 from the timer 20, so that the motor will be driven with a driving signal of duty 10/16 upon application of a clock signal $CL_2$.

Next, it is assumed that, when the rotor 49 is driven with a driving signal of duty 10/16, the load on the rotor 49 is relatively high and the rotor 49 can step with difficulty and that such induced voltage as shown in FIG. 16 or FIG. 18 is applied to the inverters 46 or 47. In this case, assuming that such voltage as shown in FIG. 16 is induced at the end of the electromagnetic coil 44, the output of S-R FF 42 is of "L" level and the output of OR gate 33 will be of "H" level. As a result, a compensation pulse signal is generated. However, as the rotor 49 has already stepped, the compensation pulse signal acts only to somewhat rotate the rotor 49 in a reverse direction or to vibrate it. Then the rotor 49 will be driven again with a driving signal of duty cycle 11/16.

In case such voltage as shown in FIG. 18 is induced in the electromagnetic coil, all of the outputs of S-R FF 39, 40 and 41 are of "H" level and the output of OR gate 33 is also of "H" level. As a result, a compensation pulse signal is generated. Therefore, even if the load on the rotor changed in the period following the second detection period e as shown in FIG. 18 and the rotor 49 has returned to its precedent position, the rotor will step by means of the compensation pulse signal.

It is to be understood that, although the invention has been described in connection with a particular embodiment, the invention should not be limited thereto and can be subjected to various changes or modifications without departing from the spirit of the invention. For example, a driving signal need not be a pulse train, but may be a continuous pulse signal; other means than a timer may be employed to weaken the driving force of a rotor to the stepping motor, and detection periods for determining failure of rotor stepping may be shifted depending upon different driving pulse signals.

What I claim is:

1. An electronic timepiece comprising:

a stepping motor including a rotor for driving hands of the timepiece and an electromagnetic coil;

driving pulse generating means and compensation pulse generating means for generating signals for driving said stepping motor;

driving energy control means for controlling energy of said driving signals;

induced voltage detecting means for detecting voltage induced in said electromagnetic coil of the stepping motor and generating a detection signal representative thereof;

means for determining failure of stepping of the rotor of the stepping motor from the detection signal from said induced voltage detecting means; and a detection controlling means for activating said induced voltage detecting means;

wherein said stepping failure determination means detects stepping rotor failure and controls said compensation pulse generating means to supply a compensation pulse to said rotor to compensate for the stepping rotor failure and to said driving energy control means to increase the energy of the driving pulse to compensate for increase in a load on the timepiece;

said detection controlling means monitoring the detection signal produced by said induced voltage detection means during at least two independent detection periods, said stepping failure determination means including a plurality of stepping failure determination elements provided in correspondence with said detection periods respectively wherein said compensation pulse generating means supplies a compensation pulse when at least one of said stepping failure determination elements detects the failure of stepping of the rotor.

at least one of said stepping failure determination elements detecting stepping failure when the detection signal exceeds a predetermined reference level while another of said stepping failure determination elements detects stepping failure when the detection signal does not exceed a predetermined reference level.

2. An electronic timepiece according to claim 1 said detection controlling means including a circuit for generating electromagnetic coil switching pulses, said electromagnetic coil being intermittently switched by said electromagnetic coil switching pulses after completion of application of the driving pulse to said stepping motor.

3. An electromagnetic timepiece according to claim 2 wherein said stepping failure determination elements each include selecting gates for selecting the detection signal from said induced voltage detecting means, said selecting gates are selected in synchronism with said electromagnetic coil switching pulse.

4. An electromagnetic timepiece according to claim 3 wherein said driving energy control means comprises a duty cycle determining circuit for generating a duty cycle signal for chopping said driving pulse.

5. An electromagnetic timepiece according to claim 4 wherein said duty cycle determining circuit includes duty cycle selecting gates which receive a plurality of input signals having different frequencies and generates a plurality of output signals each representative of a different duty cycle and a counter means for controlling said duty cycle selecting gates.

6. The electronic timepiece of claim 1 wherein said drive energy control means comprises:

duty cycle control means for varying the pulse width of the pulses applied by said drive pulse generating means and compensation pulse generation means to increase said pulse width when stepping failure is detected by said means for determining.

7. The electronic timepiece of claim 6 wherein said duty cycle control means decreases the pulse width of said pulses when stepping motor failure is not detected for a predetermined time period.

* * * * *